US006945044B2

(12) United States Patent
Gimsa

(10) Patent No.: US 6,945,044 B2
(45) Date of Patent: Sep. 20, 2005

(54) DUAL CYCLE HOT GAS ENGINE COMPRISING TWO MOVABLE PARTS

(75) Inventor: Andreas Gimsa, Wilhelmshorst (DE)

(73) Assignee: Enerlyt Position GmbH, Potsdam (DE)

( * ) Notice: Subject to any disclaimer, the term of this patent is extended or adjusted under 35 U.S.C. 154(b) by 0 days.

(21) Appl. No.: 10/685,820

(22) Filed: Oct. 14, 2003

(65) Prior Publication Data

US 2004/0128994 A1 Jul. 8, 2004

(30) Foreign Application Priority Data

Oct. 15, 2002 (DE) ..... 102 48 785
Jun. 26, 2003 (DE) ..... 103 29 977

(51) Int. Cl.[7] ..... F01B 29/10
(52) U.S. Cl. ..... 60/517; 92/51.52
(58) Field of Search ..... 60/517, 520, 526; 92/51, 52, 53; 123/53, 6

(56) References Cited

U.S. PATENT DOCUMENTS 1,530,539 A * 3/1925 Bernhard ..... 123/53.6
1,666,941 A * 4/1928 Morris ..... 123/53.6
4,404,802 A * 9/1983 Beale ..... 60/520
4,722,188 A * 2/1988 Otters ..... 60/517
5,456,076 A * 10/1995 Zornes ..... 60/525
5,488,830 A * 2/1996 Burt ..... 62/6
6,460,347 B1 * 10/2002 Fujiyama et al. ..... 62/6

* cited by examiner

*Primary Examiner*—Hoang Nguyen
(74) *Attorney, Agent, or Firm*—Merchant & Gould

(57) ABSTRACT

The invention relates to a dual cycle hot gas engine comprising pistons which are movable inside one another, a dual external piston being arranged for axial movement inside a basic cylinder member, and a dual internal piston being arranged for axial movement inside the dual external piston.

19 Claims, 5 Drawing Sheets

DUAL CYCLE HOT GAS ENGINE COMPRISING TWO MOVABLE PARTS

BACKGROUND OF THE INVENTION

German patent DE 199 38 023 for the first time discloses a hot gas engine including pistons which are movable inside one another, the range of stroke of the internal operating piston being located in the center of the range of stroke of the external piston. German patent DE 100 16 707 for the first time discloses such an engine as a free piston version.

Pressure variations of a hot gas engine may be utilized to drive diaphragms or piezo ceramics, provided the structure of the engine permits dispensing with a gear transmission for realizing one or more hot gas cycles (continuous processes). German patent DE 102 40 750, for example, describes such a gearless hot gas engine.

SUMMARY OF THE INVENTION

It is an object of the invention to disclose an improved dual cycle hot gas engine which operates with but two movable parts. Moreover, a possibility is suggested of how to increase the compression ratio of such an engine.

The object is met, in accordance with the invention, by a dual cycle hot gas engine comprising a dual external piston arranged to be axially movable inside a basic cylinder member and a dual internal piston arranged to be axially movable inside the dual external piston.

DETAILED DESCRIPTION OF DISCLOSED EMBODIMENTS

Figure 1:
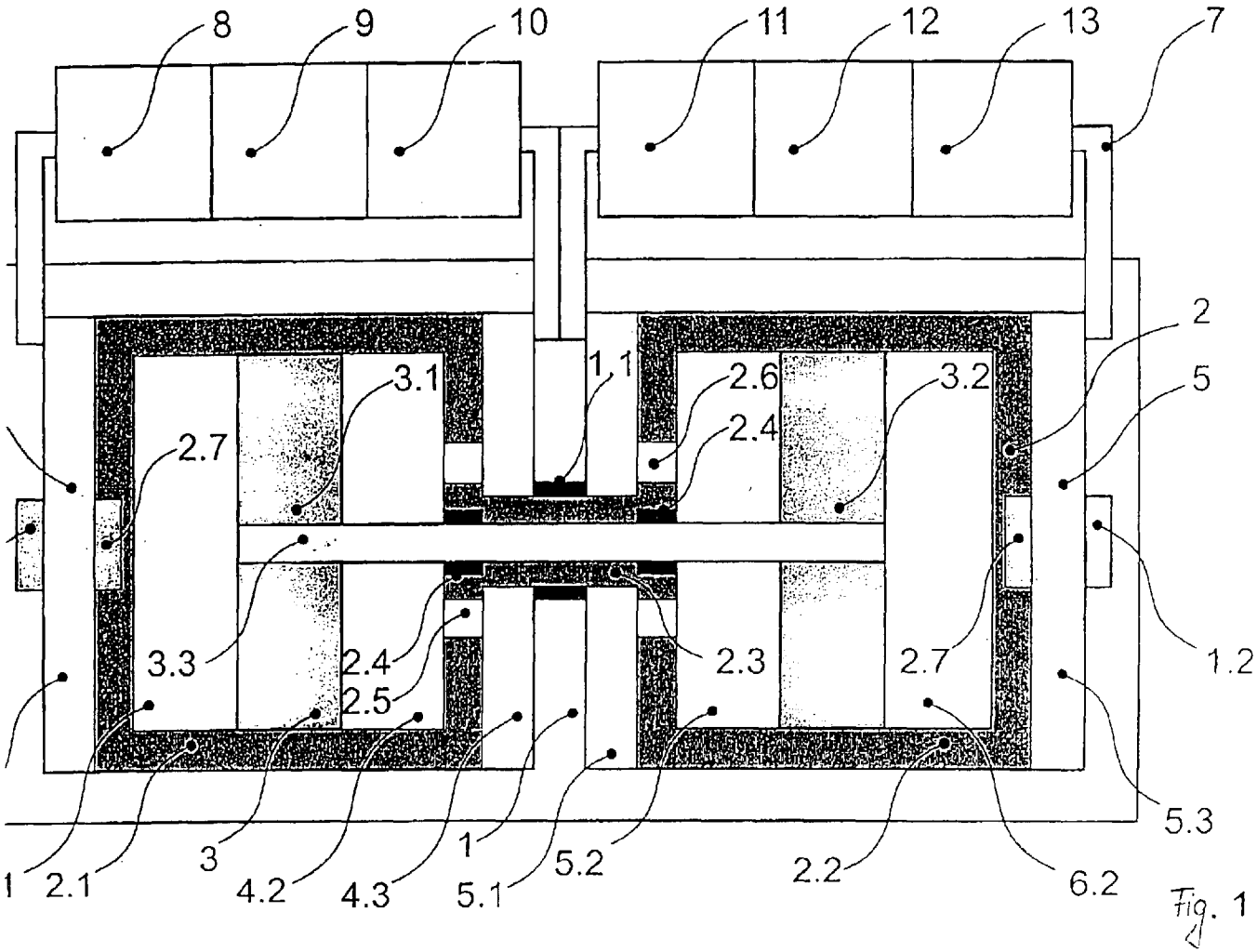
FIG. 1 is a sectional view of an engine according to a disclosed embodiment of the invention.

Movement of the dual external piston 2 influences the total volume of the working gas even when the internal piston is inoperative. During operation, the dual internal piston 3 attains twice the speed of the dual external piston 2.

Driven by the alternating working gas pressure, the dual internal piston 3 leads the dual external piston 2. The dual internal piston 3, by moving, causes the pressure of the buffer gas to vary in the spaces 6.1 and 6.2, thereby urging the external piston in the same direction. The dual external piston 2 is prevented from striking against the cylinder wall by the interaction of its magnets 2.7 and the magnets 1.2 which are located externally.

Figure 2:
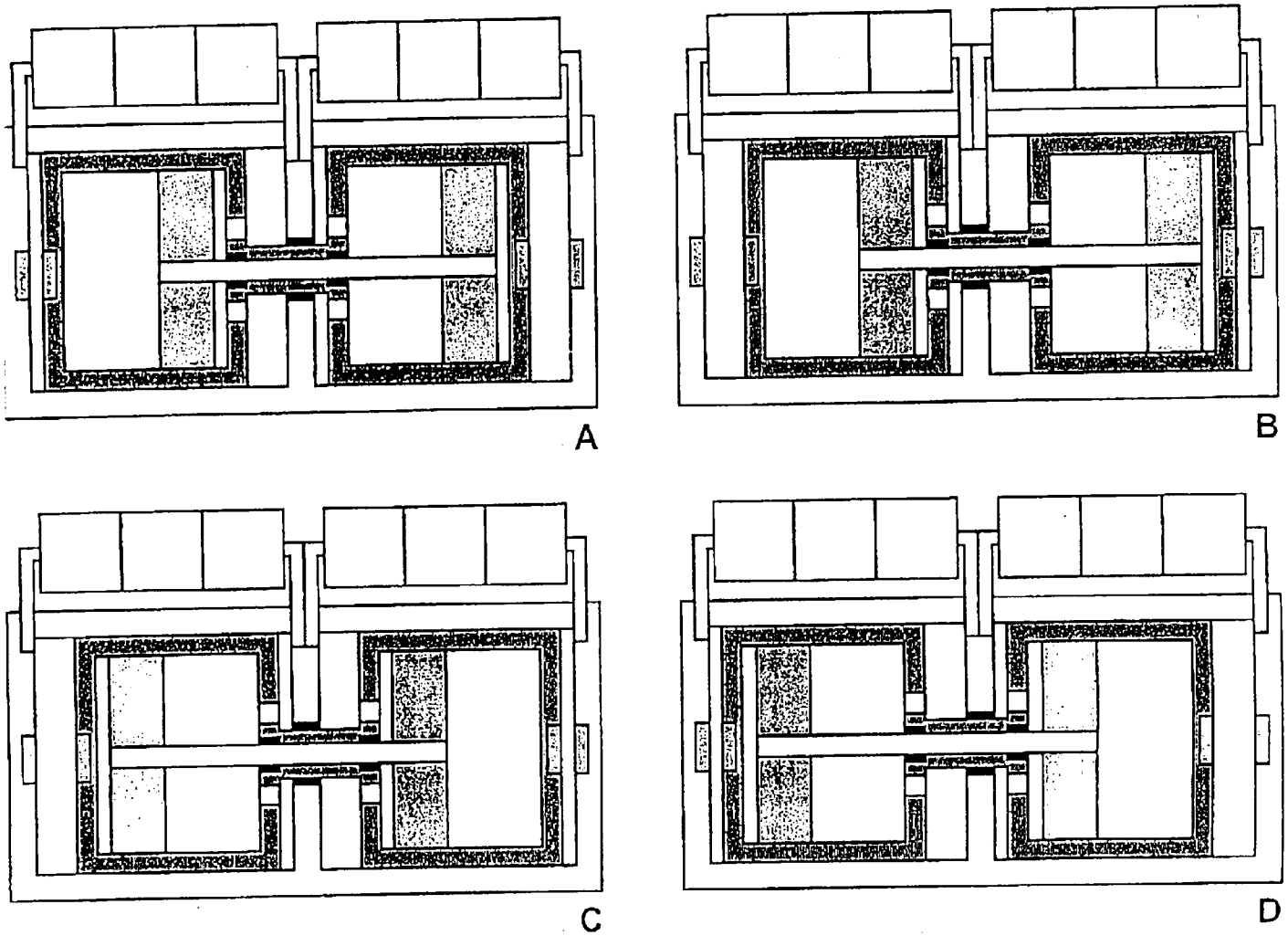
FIGS. 2A–2D illustrate four gas cycles of the engine shown in FIG. 1.

In FIG. 2, from A to B, the isochoric heat supply from the regenerator is shown for the first gas cycle as is the isochoric heat abduction to the regenerator for the second gas cycle.

The subsequent isothermic heating for the first cycle and isothermic cooling for the second cycle progress from B to C. The working gas volume rises for the first cycle and drops for the second cycle. From C to D, the isochoric heat abduction to the regenerator takes place for the first cycle and the isochoric heat supply from the regenerator for the second cycle. At decreasing working gas volume for the first cycle, the course of the isothermic cooling is from D to A in FIG. 2 as is the course of the isothermic heating at increasing working gas volume for the second cycle.

FIG. 1 illustrates the fundamental structure of the engine with its essential components. The two gas cycles operate at a phase shift of 180 ϕ. The piston rod 3.3 may be hollow so as to interconnect the buffer gas spaces 6.1 and 6.2. In this case the buffer gas volume is constant and independent of piston positions. A defined pressure drop can be adjusted by reducing the cross section of the opening in the piston rod 3.3 so as to achieve pressure variation in the buffer gas spaces 6.1 and 6.2 as the dual internal piston 3 moves.

Also a cup-shaped design of the internal pistons 3.1 and 3.2 is feasible, while maintaining the necessary piston sealing surfaces. In that event the cup openings would face the magnets 2.7. Hereby the buffer gas pressure is brought down to a lower level.

The structure of the engine may be described as follows:

Inside a basic cylinder member 1 a dual external piston 2 is arranged so as to be axially movable, and inside this dual external piston 2 a dual internal piston 3 is arranged so as to be axially movable.

The basic cylinder member 1 has two outer end walls and a partition in parallel with the same, whereby two like spaces are defined in the interior of the basic cylinder member 1. A central bore is formed in the central partition of the basic cylinder member 1, adapted to receive at least one sliding seal 1.1. The dual external piston 2 connects two external pistons 2.1 and 2.2 to each other by means of a hollow piston rod 2.3, the piston rod 2.3 being passed tightly through the sliding seal 1.1.

The dual internal piston 3 connects two internal pistons 3.1 and 3.2 to each other by means of a piston rod 3.3, and the piston rod 3.3 is passed tightly through the sliding seals 2.4 which are located in the hollow piston rod 2.3.

The end surfaces of the basic cylinder member 1 contain magnets 1.2 which interact by mutual repulsion with magnets 2.7 located in the end surfaces of the dual external piston 2 (springs are conceivable as well).

The external piston 2.1 is formed with apertures 2.5 in its end surface remote from the magnets, through these apertures the gas space 4.2 communicates with the gas space 4.3. The external piston 2.2 is formed with apertures 2.6 in its end surface remote from the magnets, through these apertures the gas space 5.1 communicates with the gas space 5.2.

As an alternative to the apertures 2.5 mentioned above, the external piston 2.1 may have such apertures in its end surface facing the magnets in which case the gas space 4.1 would communicate with the gas space 6.1. The gas space 4.2 thus becomes a buffer space.

As an alternative to the apertures 2.6 mentioned above, the external piston 2.2 may have such apertures in its end surface facing the magnets in which case the gas space 6.2 would communicate with the gas space 5.3. The gas space 5.2 thus becomes a buffer space.

Gas space 4.1 communicates with gas space 4.3 via a heater 8, a regenerator 9, and a cooler 10; gas space 5.1 communicates with gas space 5.3 via a cooler 11, a regenerator 12, and a heater 13.

In another adequate arrangement the heater and cooler may be exchanged: the place of the heater 8 or 13 will be taken by a cooler, and the place of the cooler 10 or 11 will be taken by a heater.

The engine may be modified in order to increase the compression ratio and limit the pressure amplitude in the spaces which serve as buffer gas spaces. This object is met in that the two buffer gas spaces are converted into working gas spaces.

Figure 3:
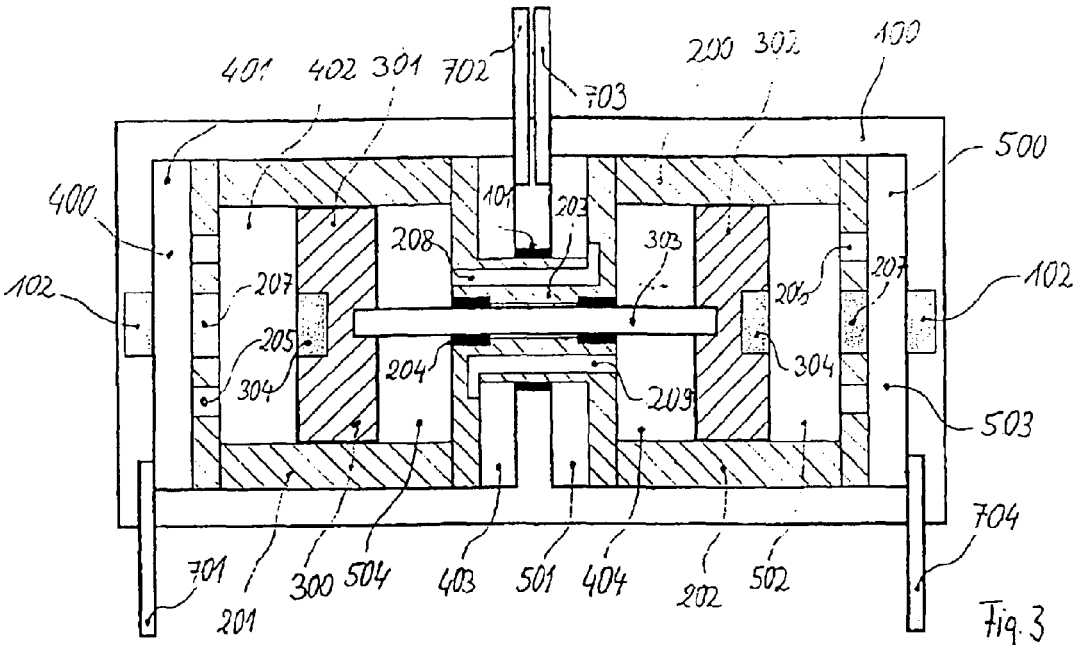
FIG. 3 shows the basic structure of the engine shown in FIG. 1.

FIG. 3 illustrates the basic structure of the engine. In a basic cylinder member 100 there are two dual pistons, the external piston 200 and the internal piston 300. The basic cylinder member encloses the external piston 200 which in turn incorporates the internal piston 300.

Cylindrical magnets arranged for mutual repulsion are disposed in the end faces of the cylinder and of the pistons.

The first working gas cycle takes place in the following spaces: 401, 402, 403, 404 as well as in interior spaces of 800, 900, 1000 and in conduits which interconnect interior spaces. The second working gas cycle takes place in the following spaces: 501, 502, 503, 504 as well as in interior spaces of 1100, 1200, 1300 and in conduits which interconnect interior spaces.

The arrangement of a hot gas engine according to the invention is characterized by the fact that gas space 403 communicates with gas space 404 and that gas space 501 communicates with gas space 504. The first gas connection is linked to one of the two working gas cycles, while the second gas connection is linked to the second working gas cycle. Both working gas cycles are sealed tightly from each other.

The respective connecting apertures may be designed as continuous bores (passages 208 and 209) extending parallel to the central axis of the hollow piston rod 203. The mutual gas connection may be implemented in the internal limiting covers of the dual external piston 200.

Another possibility is to form at least one of the passages in the piston rod 303 of the dual internal piston 300.

For thermic decoupling of heater and cylinder, a respective pulse tube for each of the two cycles may be suitably arranged such that its central axis will extend at right angles to the central axis of the basic cylinder member 100 of the engine.

Figure 6:
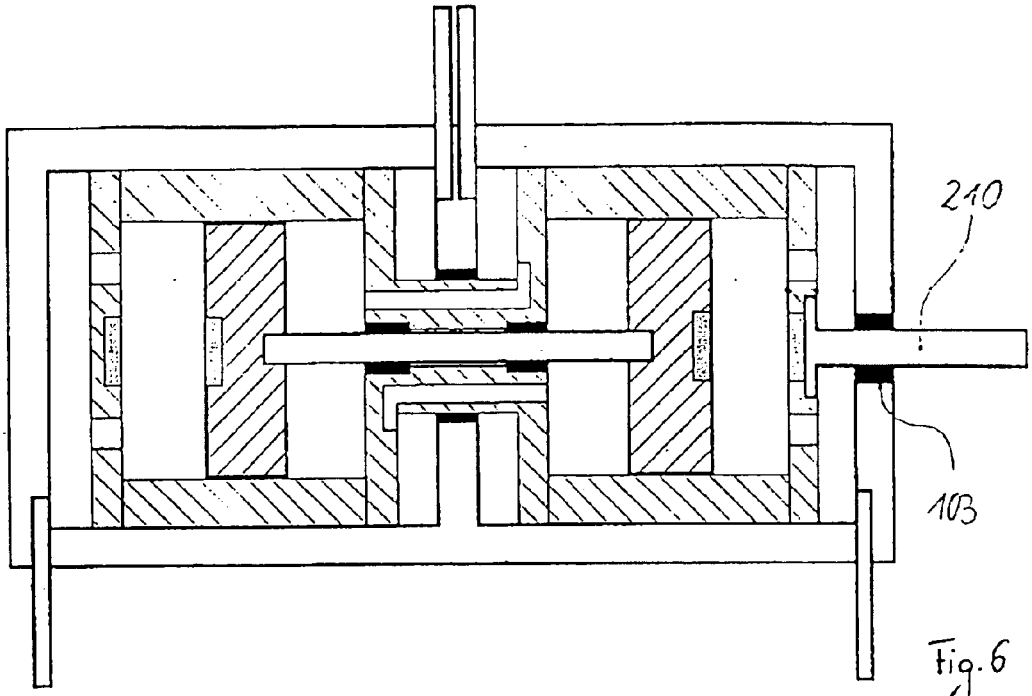
FIG. 6 shows a modification for producing mechanical power according to a modification of the disclosed embodiment.

If power needs to be carried off mechanically from the dual external piston 200 through the cylinder wall to the outside (FIG. 6) a piston rod 210 is fixed to the dual external piston 200. The piston rod passes tightly through the cylinder wall to the outside so as to be able to carry out linear strokes. To accomplish that, a seal 103 is required which is disposed at the cold end of the engine in the arrangement described.

The magnets 102 may be dispensed with when limitation of the stroke of the dual external piston 200 is provided outside of the basic cylinder member. To permit power to be carried off to the outside in this case and to limit the stroke of the dual external piston 200, the piston rod is connected mechanically to the center of a diaphragm, to a connecting rod pivoted at a crankshaft, or to the coil member of a linear generator.

Figure 7:
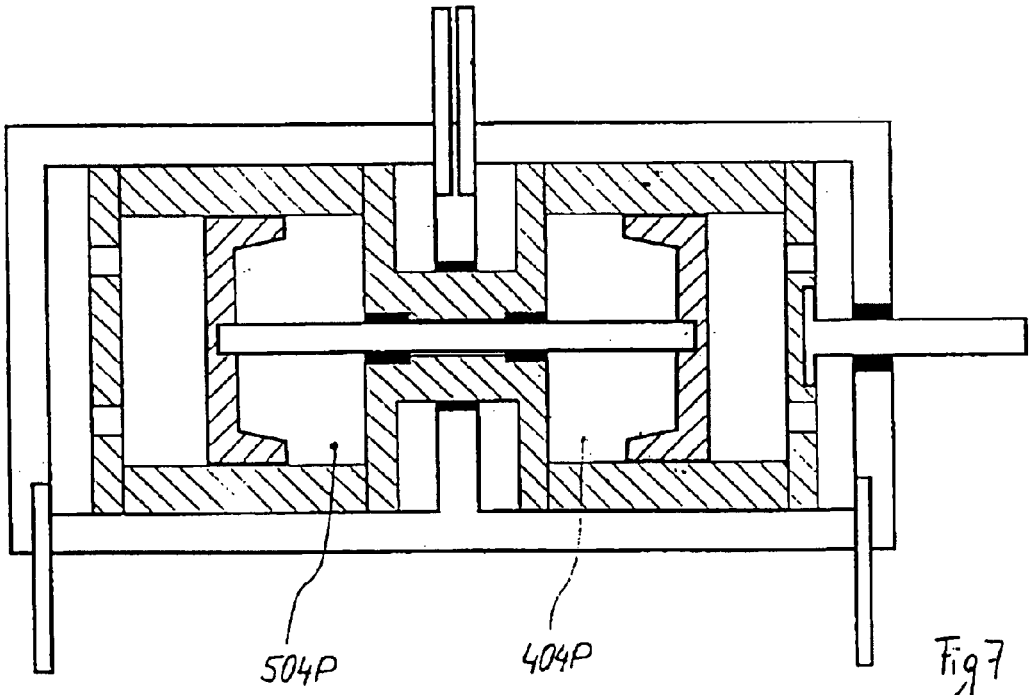
FIG. 7 shows another modification of the disclosed embodiment.

FIG. 7 illustrates an engine which can do entirely without magnets. To accomplish that, the working gas spaces 404 and 504 are converted into buffer gas spaces 404P and 504P. In this way, the buffer gas which is compressed by the movements of the dual internal piston 300 serves to transmit pulses to the dual external piston 200.

Alternatively, while retaining the working gas spaces 404 and 504 and the connecting passages 208 and 209, the cross section of the passages may be utilized to adjust the gas spring acting in them in such manner that magnets can be dispensed with. Defined dampening can be adjusted, for example, by way of the external heat transmitting structural elements.

Figure 4:
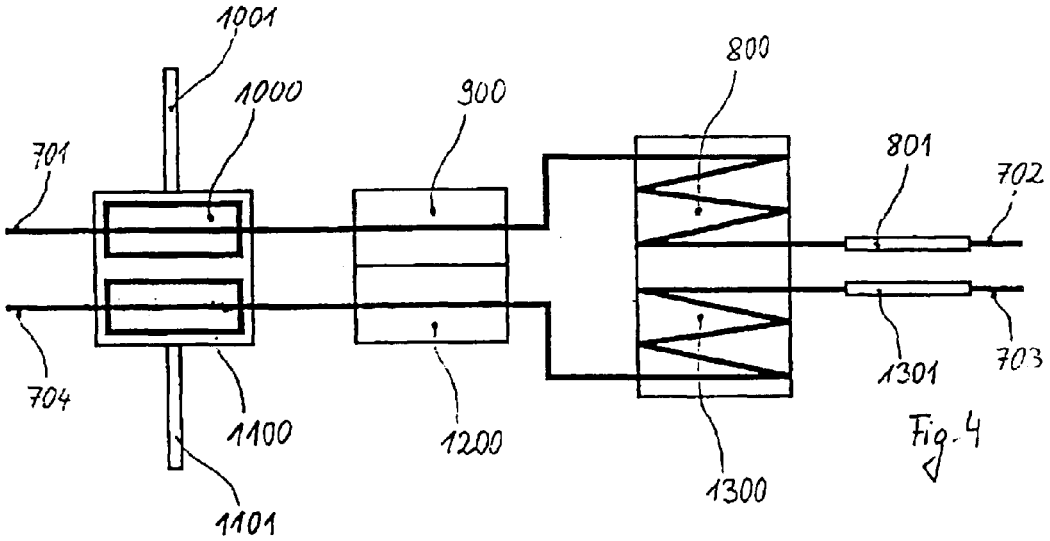
FIG. 4 is a schematic arrangement of the heat transmitting elements according to the disclosed embodiment.

FIG. 4 is a diagrammatic presentation of the arrangement of the heat transmitting structural elements: heater, regenerator, and cooler for each working gas cycle. The heater 800 and the heater 1300 may be combined for operation by means of one burner in that the two heaters are designed as successive sets of helical windings of one basic heater member. Linking the two coolers 1000 and 1100 presents another convenient arrangement. If they are designed as a tubular heat exchanger, for instance, they may be separated at the gas end and combined at the water end for both cycles.

Figure 5:
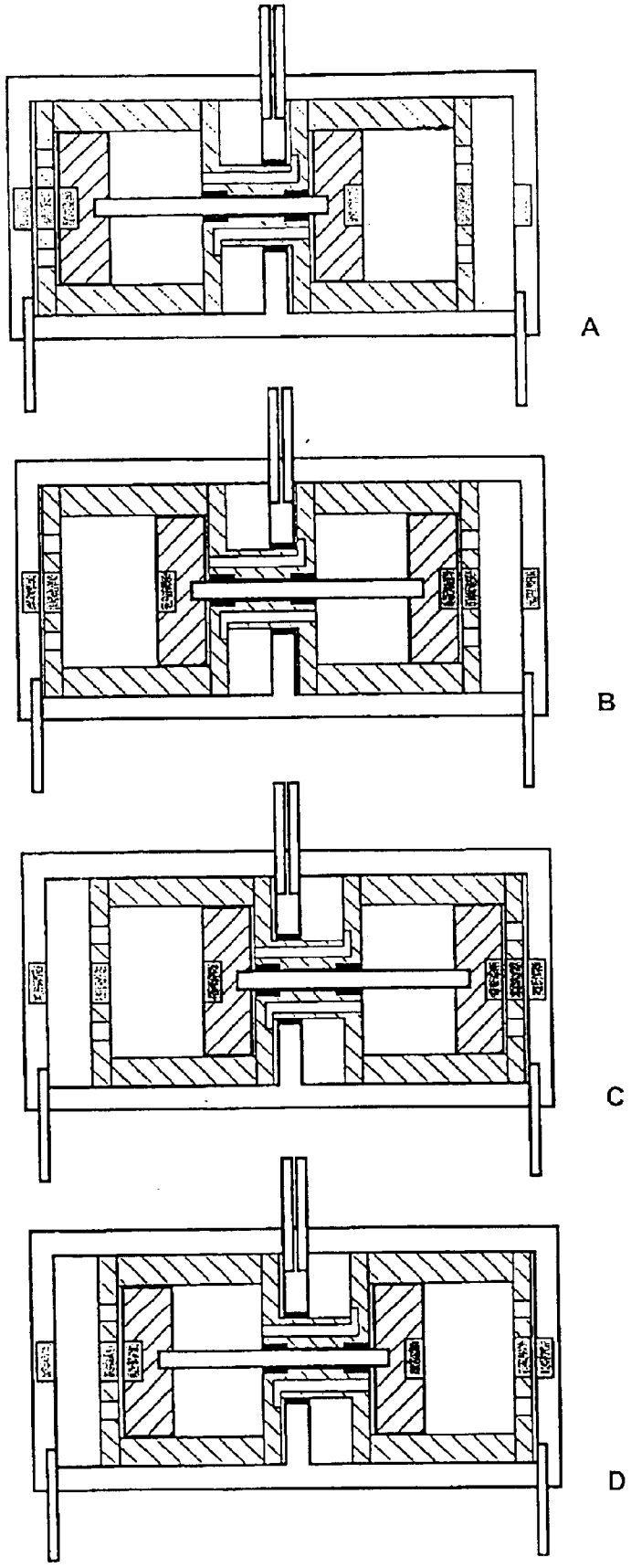
FIGS. 5A–5D illustrate the function of the engine shown in FIG. 1.

FIG. 5 illustrates the course of changes of states and the function of the system.

At position A, both pistons are on the left-hand side. The working gas of the first cycle is under high pressure (e.g. 15 bars) prior to expansion. The volume is compressed into space 403. The working gas of the second cycle is in a state prior to compression, i.e. under low pressure (e.g. 5 bars). The volume is great and gas is in spaces 502, 503, and 504.

As the dual internal piston 300 moves from A to B, the dual external piston 200 remains in its left-hand position. Movement of the dual internal piston 300 from the left to the right is brought about by the pressure difference across the piston sides. At the same time, heat is supplied from the heater of the first cycle, and heat is transmitted to the cooler of the second cycle. At the end of the movement, the pressures of both cycles have approximated each other. Now, the pressure in both cycles is 10 bars, for example.

Once the pressure has become reduced in the first cycle, the left-hand magnet 207 can cast off from the magnet 102 on the left. The kinetic energy of the dual internal piston 300 is transmitted as a pulse to the dual external piston 200. During the movement from B to C, the right-hand magnet 304, acting through the right-hand magnet 207, pushes the dual external piston 200 to the right. The volume of the first cycle remains constantly high, and the volume of the second cycle remains constantly low. The displacement produces flows through both regenerators and, therefore, the pressure in the first cycle drops (e.g. to 5 bars), while the pressure in the second cycle rises (e.g. to 15 bars).

As the dual internal piston 300 moves from C to D, the dual external piston 200 remains in its right-hand position. Movement of the dual internal piston 300 from the right to the left is brought about by the pressure difference across the piston sides. At the same time, heat is transmitted to the cooler of the first cycle, and heat is supplied from the heater of the second cycle. At the end of the movement, the pressures of both cycles have approximated each other. Now, the pressure in both cycles is 10 bars, for example.

Once the pressure has become reduced in the second cycle, the right-hand magnet 207 can cast off from the magnet 102 on the right. The kinetic energy of the dual internal piston 300 is transmitted as a pulse to the dual external piston 200. During the movement from D to A, the left-hand magnet 304, acting through the left-hand magnet 207, pushes the dual external piston 200 to the left. The volume of the first cycle remains constantly low, and the volume of the second cycle remains constantly high. The displacement produces flows through both regenerators and, therefore, the pressure in the first cycle rises (e.g. to 15 bar), while the pressure in the second cycle drops (e.g. to 5 bars).

The features disclosed in the specification above, in the claims and drawings may be essential to implementing the invention in its various embodiments, both individually and in any desired combination.

List of Reference Numerals

1 basic cylinder member
1.1 seal to separate the two gas cycles
1.2 magnet for repulsion from 2.7
2 dual external piston
2.1 external piston first gas cycle
2.2 external piston second gas cycle
2.3 piston rod of 2
2.4 seal in 2.3
2.5 gas communication aperture in 2.1
2.6 gas communication aperture in 2.2
2.7 magnet for repulsion from 1.2
3 dual internal piston
3.1 dual internal piston first gas cycle
3.2 dual internal piston second gas cycle
3.3 piston rod of 3
4 working gas first gas cycle
4.1 gas space 4.1
4.2 gas space 4.2
4.3 gas space 4.3
5 working gas second gas cycle
5.1 gas space 5.1
5.2 gas space 5.2
5.3 gas space 5.3
6.1 buffer gas space 1
6.2 buffer gas space 2
7 gas connecting pipe
8 heater of 4
9 regenerator of 4
10 cooler of 4
11 cooler of 5
12 regenerator of 5
13 heater of 5
100 basic cylinder member
101 seal to separate the two gas cycles
102 magnets for repulsion from magnets 207
103 piston rod seal in basic cylinder member (for piston rod 210)
200 dual external piston
201 external piston first gas cycle
202 external piston second gas cycle
203 piston rod of dual external piston
204 seals in piston rod 203
205 gas communication apertures in dual external piston 200, first gas cycle
206 gas communication apertures in dual external piston 200, second gas cycle
207 magnet for repulsion from magnet 102 in basic cylinder member and from 304
208 working gas connecting passage between gas space 501 and gas space 504
209 working gas connecting passage between gas space 403 and gas space 404
210 piston rod of external piston for power output from the machine
300 dual internal piston
301 internal piston first gas cycle
302 internal piston second gas cycle
303 piston rod of dual internal piston
304 magnet of dual internal piston for repulsion from magnet 207
400 working gas first gas cycle
401 gas space 401
402 gas space 402 (connected through 205 to 401)
403 gas space 403 (connected to 401 through 800, 900, 1000)
404 gas space 404 (connected through 209 to 403)
404P buffer gas space instead of 404
500 working gas second gas cycle
501 gas space 501
502 gas space 502 (connected through 206 to 503)
503 gas space 503 (connected to 501 through 1100, 1200, 1300)
504 gas space 504 (connected through 208 to 501)
504P buffer gas space instead of 504
701 cooler connection first gas cycle to the basic cylinder member
702 heater connection first gas cycle to the basic cylinder member
703 heater connection second gas cycle to the basic cylinder member
704 cooler connection second gas cycle to the basic cylinder member
800 heater first gas cycle
801 pulse tube for thermic decoupling of heater 800 and basic cylinder member
900 regenerator first gas cycle
1000 cooler first gas cycle
1001 water connection from cooler 1000
1100 cooler second gas cycle
1101 water connection from cooler 1100
1200 regenerator second gas cycle
1300 heater second gas cycle
1301 pulse tube for thermic decoupling of heater 1300 and basic cylinder member

What is claimed is:

1. A dual cycle hot gas engine comprising pistons which are movable inside one another, characterized in that a dual external piston (2) is arranged to be axially movable inside a basic cylinder member (1) and a dual internal piston (3) is arranged to be axially movable inside the dual external piston (2), wherein the dual external piston and the dual internal piston each comprise two double-acting single pistons rigidly connected with each other, and wherein the basic cylinder member (1) includes two outer end walls and a central partition in parallel with the same whereby two like spaces are formed in the interior of the basic cylinder member (1), with the rigid interconnection between the two double-acting single pistons of the dual external piston and the rigid interconnection between the two double-acting single pistons of the dual internal piston extending through the central partition.

2. The hot gas engine as claimed in claim 1, characterized in that the central partition of the basic cylinder member (1) is formed with a central bore to be able to receive at least one sliding seal (1.1).

3. A dual cycle hot gas engine comprising pistons which are movable inside one another, characterized in that the dual external piston (2) is arranged to be axially movable inside a basic cylinder member (1) and a dual internal piston (3) is arranged to be axially movable inside the dual external piston (2);

the basic cylinder member (1) includes two outer end walls and a central partition in parallel with the same, whereby two like spaces are formed in the interior of the basic cylinder member (1);

the central partition of the basic cylinder member (1) is formed with a central bore to be able to receive at least one sliding seal (1.1); and the dual external piston (2) interconnects two external pistons (2.2 and 2.2) by a hollow piston rod (2.3), and the hollow piston rod (2.3) is guided tightly through the sliding seal (1.1).

4. The hot gas engine as claimed in claim 3, characterized in that the dual internal piston (3) interconnects two internal pistons (3.1 and 3.2) by a piston rod (3.3), and the piston rod (3.3) is guided tightly through sliding seals (2.4) which are located in the hollow piston rod (2.3).

5. The hot gas engine as claimed in claim 4, characterized in that the end surfaces of the basic cylinder member (1) include magnets (1.2) for mutually repelling interaction with magnets (2.7) disposed in the end surfaces of the dual external piston (2) (springs are conceivable too).

6. The hot gas engine as claimed in claim 5, characterized in that the external piston (2.1) has apertures (2.5) in its end surface remote from the magnets which apertures connect the gas space (4.2) with the gas space (4.3).

7. The hot gas engine as claimed in claim 5, characterized in that the external piston (2.2) has apertures (2.6) in its end surface remote from the magnets which apertures connect the gas space (5.1) with the gas space (5.2).

8. The hot gas engine as claimed in claim 5, characterized in that the external piston (2.1) has apertures (2.5) in its end surface facing the magnets which apertures connect the gas space (4.1) with the gas space (6.1); gas space (4.2) becoming a buffer space.

9. The hot gas engine as claimed in claim 8, characterized in that the external piston (2.2) has apertures (2.6) in its end surface facing the magnets which apertures connect the gas space (6.2) with the gas space (5.3); gas space (5.2) becoming a buffer space.

10. The hot gas engine as claimed in claim 8, characterized in that the gas space (4.1) communicates with the gas space (4.3) via a heater (8), a regenerator (9), and a cooler (10), and that the gas space (5.1) communicates with the gas space (5.3) via a cooler (11), a regenerator (12), and a heater (13).

11. The hot gas engine as claimed in claim 10, characterized in that the heater (8 or 13) is replaced by a cooler, and the cooler (10 or 11) is replaced by a heater.

12. The hot gas engine as claimed in claim 9, characterized in that the piston rod (3.3) of the dual internal piston (3) is hollow, thus connecting the buffer gas space (6.1) with the buffer gas space (6.2).

13. The hot gas engine as claimed in claim 6, characterized in that gas space (403) communicates with gas space (404) and gas space (501) communicates with gas space (504).

14. The hot gas engine as claimed in claim 13, characterized in that the first gas connection is linked to one of the two working gas cycles, while the second gas connection is linked to the second working gas cycle.

15. The hot gas engine as claimed in claim 14, characterized in that the two gas connections are embodied by passages (208 and 209) in the hollow piston rod (203) of the dual external piston (200).

16. The hot gas engine as claimed in claim 15, characterized in that at least one of the passages is formed in the piston rod (303) of the dual internal piston (300).

17. The hot gas engine as claimed in claim 1, characterized in that a pulse tube each is provided for both cycles for thermic decoupling of heater and cylinder, the pulse tube being arranged so that is central axis extends at right angles to the central axis of the basic cylinder member (100) of the engine.

18. The hot gas engine as claimed in claim 1, characterized in that the dual external piston (200) is connected to a piston rod (210) to carry off force, and the piston rod is passed tightly through the cylinder wall to the outside.

19. The hot gas engine as claimed in claim 18, characterized in that, to carry off force to the outside and to limit the stroke of the dual external piston (200), the piston rod (210) is mechanically connected to the center of a diaphragm, a connecting rod pivoted at a crankshaft, or the coil member of a linear generator.

* * * * *

UNITED STATES PATENT AND TRADEMARK OFFICE

CERTIFICATE OF CORRECTION

PATENT NO. : 6,945,044 B2
DATED : September 20, 2005
INVENTOR(S) : Gimsa

It is certified that error appears in the above-identified patent and that said Letters Patent is hereby corrected as shown below:

Title page,
Item [73], Assignee, "Enerlyt Position GmbH" should read -- Enerlyt Potsdam GmbH --.

Signed and Sealed this

Sixth Day of December, 2005

JON W. DUDAS
*Director of the United States Patent and Trademark Office*